US007195057B2

(12) United States Patent
Blomgren

(10) Patent No.: US 7,195,057 B2
(45) Date of Patent: Mar. 27, 2007

(54) PLATE HEAT EXCHANGER AND END PLATE ASSOCIATED THEREWITH

(75) Inventor: Ralf Blomgren, Skanör (SE)

(73) Assignee: Alfa Laval Corporate AB, Lund (SE)

( * ) Notice: Subject to any disclaimer, the term of this patent is extended or adjusted under 35 U.S.C. 154(b) by 108 days.

(21) Appl. No.: 10/480,896

(22) PCT Filed: Jun. 4, 2002

(86) PCT No.: PCT/SE02/01064

§ 371 (c)(1),
(2), (4) Date: Dec. 15, 2003

(87) PCT Pub. No.: WO03/006909

PCT Pub. Date: Jan. 23, 2003

(65) Prior Publication Data

US 2004/0182541 A1 Sep. 23, 2004

(30) Foreign Application Priority Data

Jul. 9, 2001 (SE) ..... 0102462

(51) Int. Cl.
*F28F 3/08* (2006.01)

(52) U.S. Cl. ..... 165/81; 165/167; 165/178

(58) Field of Classification Search ..... 165/81, 165/167, 82, 178
See application file for complete search history.

(56) References Cited

U.S. PATENT DOCUMENTS

| | | | | |
|---|---|---|---|---|
| 4,291,752 | A | 9/1981 | Bridgnell | |
| 5,797,446 | A * | 8/1998 | Blomgren | 165/81 |
| 6,116,332 | A * | 9/2000 | Vannman et al. | 165/81 |
| 6,119,766 | A * | 9/2000 | Blomgren | 165/81 |
| 6,260,612 | B1 * | 7/2001 | Nakamura et al. | 165/81 |
| 6,283,199 | B1 * | 9/2001 | Nakamura et al. | 165/81 |

FOREIGN PATENT DOCUMENTS

| | | |
|---|---|---|
| EP | 0 033 201 | 8/1981 |
| JP | 329492 | 11/2000 |
| JP | 329493 | 11/2000 |

* cited by examiner

*Primary Examiner*—Leonard R. Leo
(74) *Attorney, Agent, or Firm*—Fish & Richardson P.C.

(57) ABSTRACT

A plate heat exchanger has two end plates, at least one of which is provided with a number of port openings (11) to allow inflow and outflow of a number of heat exchanging fluids, and a number of heat transfer plates located between the end plates. One of the end plates (1) has two individual segments (10) that are relatively displaceable in the plane of the end plate.

11 Claims, 8 Drawing Sheets

PLATE HEAT EXCHANGER AND END PLATE ASSOCIATED THEREWITH

FIELD OF THE INVENTION

The present invention relates to a plate heat exchanger comprising two end plates, at least one of which is provided with a number of port openings to allow inflow and outflow of a number of heat exchanging fluids, and a number of heat transfer plates located between the end plates. The invention also relates to an end plate that is intended to be included in a plate heat exchanger.

BACKGROUND ART

A conventional plate heat exchanger is made up of a frame which supports two flexurally rigid clamping plates and a pack of heat transfer plates arranged between said plates. The two plates of the frame comprise a pressure plate, which is movable during assembly, and a frame plate, which is fixed during assembly, said plates being pulled together by means of bolts, thereby clamping the heat transfer plates. For the sake of simplicity, the pressure plate and the frame plate will both be referred to as end plates below. The number of heat transfer plates as well as their size is determined by the field of use of the plate heat exchanger. One of the end plates, or both, is provided with through port openings to allow inflow and outflow of a number of (usually two) heat exchanging fluids. The heat transfer plates are, in turn, provided with a number of through ports, which form a first inlet channel and a first outlet channel for a first fluid through the plate pack and a second inlet channel and a second outlet channel for a second fluid through the plate pack. These channels extending through the plate pack communicate with the through port openings of the end plates.

The heat exchanging fluids flow separately through the plate heat exchanger in different plate interspaces formed between the heat transfer plates. In most cases, every second such plate interspace communicates with the first inlet and outlet channel, each plate interspace being adapted to define a flow area and to conduct the first heat exchanging fluid between said inlet and outlet channels. Correspondingly, the other plate interspaces communicate with the second inlet and outlet channel for a flow of the second heat exchanging fluid. Fluid-tight sealing means such as a gasket or weld are provided round the through ports of the heat transfer plates. The sealing means are arranged round some of the ports alternatingly in every second plate interspace and, in the other plate interspaces, round the other ports so as to form the two separate channels for the first heat exchanging fluid and the second heat exchanging fluid, respectively.

Since the purpose of a plate heat exchanger is to achieve a heat exchange between two fluids, both the end plates and the heat transfer plates are subjected to a significant influence of temperature. This influence causes problems, as will be described below.

The heat transfer plates are usually relatively thin and are in direct contact with the heat exchanging fluids. The temperature of the fluids will thus directly affect the temperature of the heat transfer plates, the length of which will change to a certain extent depending on the coefficient of linear expansion of the plate material.

The end plates, which are located on either side of the pack of heat transfer plates, are considerably thicker than the heat transfer plates. Moreover, the end plates do not enter into direct contact with the heat exchanging fluids as do the heat transfer plates. However, the temperature of the end plates will be affected on one side of the end plate by the environment surrounding the plate heat exchanger and, on the other side, by the temperature of the respective outermost heat transfer plates in the plate pack.

The changes in length will vary due to the difference in the influence of temperature between the end plates and the heat transfer plates in combination with different plate thickness. In addition, the different length changes of the end plates and heat transfer plates may be reinforced by the fact that the plates are often made of different materials having, thus, different coefficients of linear expansion. The different length changes of the plates result in high tensions in the attachment of the connections between the end plates and the heat transfer plates, which leads to an increased risk of fatigue damage.

However, the primary cause of fatigue damage is the difference in thermal inertia between the end plates and the heat transfer plates. A rapid change in the temperature of the fluids will cause the temperature of the heat transfer plate to change immediately whereas the temperature of the end plate will change very slowly. In many processes, temperature variations occur during operation, for example in batch processes. In batch processes, a certain amount of components, such as fluids, powder or pellets, is processed for a certain period of time, following which the process is interrupted to allow emptying, cleaning and charging of a new batch. Thus, a batch process involves many starts and stops in connection with which the temperature changes from a maximum value to a minimum value.

Fatigue damage in the attachment of the connections between the end plates and the heat transfer plates is due to a number of factors and may lead to fracture in the material and thus to a shortened service life of the plate heat exchanger.

To compensate for the different changes in length of the end plates and the heat transfer plates, it is proposed in U.S. Pat. No. 6,119,766 to arrange one or more bellows on the plate heat exchanger. The bellows are connected to an end plate provided with port openings and to the associated outer heat transfer plate and are adapted to absorb any movements between the frame and the pack of heat transfer plates.

However, there are several fields of application in which a plate heat exchanger provided with bellows as described above cannot be used. For example, the bellows design does not allow high pressures to be used in the plate heat exchanger. To withstand high pressures, in the range of 100–150 bars (10–15 Mpa), the thickness of the material of which the bellows are made must be great, which means that the bellows will be rigid. However, such a rigid design means that the bellows lose their flexibility and thus their capacity to absorb movement between the end plates and the heat transfer plates in a satisfactory manner.

Furthermore, a plate heat exchanger provided with a bellows cannot be used, for example, in certain types of chemical applications where specific materials that are resistant to chemical attack must be used. In most cases, no such bellows are available since different kinds of ceramic materials are often used to obtain the chemical durability. Ceramic materials are usually brittle and cannot be used in bellows of the kind described in U.S. Pat. No. 6,119,766.

JP 2000 329493 discloses a plate heat exchanger comprising an end plate provided with slits. The slits are adapted to absorb small deformations when a thermal stress is applied to both the inlet and the outlet holes on the end plate.

The end plate, which for reasons related to manufacture, no doubt, is made in one piece, is provided with two parallel slits. The slits extend from the opposite longitudinal edges across the main portion of the width of the end plate adjacent to the outlet/inlet holes.

The design of the slits in JP 2000 329493 allows only small deformations of about 1/100 mm to be absorbed. Larger deformations will cause cracks to appear at the extreme ends of the slits and the end plate will thus be damaged.

Accordingly, the plate heat exchanger design described in JP 2000 329493 cannot be used in large plate heat exchangers, in which the thermal deformations may be several millimetres.

Various designs of plate heat exchangers and of parts included therein have been known for a long time. One example is EP 033,201, which discloses a frame for a plate heat exchanger. In conventional manner, the frame is made up of two end plates, which however in turn are divided into a number of units. The purpose of this division of the end plates into units is on the one hand to allow simpler and more rational manufacturing and, on the other hand, to facilitate the handling and assembly of the end plates and the plate heat exchanger. In order to serve as conventional end plates, the different units are assembled into rigid plates in connection with the assembly of the plate heat exchanger.

Thus, there is currently no plate heat exchanger concept in which the plate pack is clamped between two end plates and which can be used in a satisfactory manner under the conditions described above, for example at high pressures and in a chemically aggressive environment, and which can absorb considerable thermal deformations.

SUMMARY OF THE INVENTION

One object of the invention is therefore to provide a plate heat exchanger which solves or at least alleviates the above problems. The purpose is to provide a plate heat exchanger with a simple construction that in a satisfactory manner can be used under different conditions, for example at high pressures and in chemically aggressive environments, and which is capable of absorbing thermal deformations. Further objects and advantages of the invention will be apparent from the following description.

The objects of the invention have been achieved by a plate heat exchanger of the type mentioned by way of introduction, which is characterised in that one of the end plates comprises two individual segments that are relatively displaceable in the plane of the end plate. In the event of a change in length and width in the heat transfer plates that does not occur as rapidly in the end plates or is non-existent in these plates, the segments of the end plate are thus able to move in different directions in the plane of the end plate. Consequently, the displaceable segments of the end plate can compensate for the length changes in the heat transfer plates, and the stress in the attachments of the connections between the port openings of the end plates and the inlet and outlet channels formed through the pack of heat transfer plates is thus reduced. Furthermore, the plate heat exchanger does not comprise any components that prevent use at high temperatures and in chemically aggressive environments. Accordingly, the inventive construction of the plate heat exchanger provides a solution to the above problems.

Preferred embodiments of the plate heat exchanger are defined in dependent claims 2–9.

According to a preferred embodiment, each segment of the end plate comprises a port opening. Compensation, as described above, for varying length changes in the end plates and the heat transfer plates can thus be achieved at each connection between the port openings of the end plates and the channels formed through the heat transfer plates. This means that each attachment of connections is exposed to the least possible stress and that the fatigue damage can be further reduced.

According to another preferred embodiment, said port openings are positioned on the end plate along the same geometric centre line. This positioning of the port openings is advantageous from the point of view of manufacture, for example in that it allows a narrow end plate and, thus, a narrow plate heat exchanger to be obtained. This design of the end plate permits a similar design of the heat transfer plates, which are thus allowed to be mixed with each other by rotating them about their longitudinal axis. This is preferred from the point of view of manufacture since only one embodiment of the heat transfer plate is needed in the plate heat exchanger.

Segmenting such an end plate, on which the port openings are positioned along a geometric centre line is advantageous. Due to its shape, the long and narrow end plate is subjected to considerable length changes in connection with temperature variations, and these changes are thus compensated for by the segmentation.

According to yet another preferred embodiment, a surface with increased friction is arranged on at least one of the segments of the end plate and/or on an adjacent plate. Said adjacent plate may be either the outermost plate of the pack of heat transfer plates or a plate arranged between the end plates and the pack of heat transfer plates. Due to the friction, a flexibility is obtained between the end plate and said adjacent plate when length changes occur in the plates. The stress on the connections between the plates is thereby reduced.

According to a preferred embodiment, said increased friction is obtained by providing at least one of the segments round a port opening of the end plate with a fixing pattern for engagement with the adjoining plate. The engagement thus enhances the flexibility between the plates.

The flexibility between the end plates and the pack of heat transfer plates may be further enhanced if the plate adjoining the end plate is provided with a fixing pattern corresponding to that of the end plate.

According to another preferred embodiment, a sliding element is arranged between the heat transfer plates and the adjoining end plate. Despite the above-mentioned engagement between the segments of the end plates and the adjacent plates, some movement may occur between the end plates and the pack of heat transfer plates. This movement increases as a function of the distance to the port openings provided on the end plate, where the segments engage the pack of heat transfer plates. By means of the sliding element the wear that would otherwise have occurred between the end plates and the neighbouring heat transfer plates can thus be avoided.

Moreover, the sliding element is adapted to engage the neighbouring heat transfer plate, tracing its movements. The sliding element is thereby slideably displaced towards the more wear-resistant end plate.

According to a preferred embodiment, the engagement between the sliding element and the neighbouring heat transfer plate is achieved by means of a fixing pattern provided on either or both of the sliding element and the heat transfer plate.

A further object of the present invention is to provide an end plate adapted to be used according to the plate heat exchanger stated above. The end plate exhibits the general features stated in claim 10, preferred embodiments being defined in appended claims 11–13. The same advantages as stated above are obtained by means of an end plate that is designed according to these claims.

BRIEF DESCRIPTION OF THE DRAWINGS

Further features and advantages of the present invention will be apparent from the following description of currently preferred embodiments, with reference to the accompanying schematic drawings.

DESCRIPTION OF PREFERRED EMBODIMENTS

Figure 1:
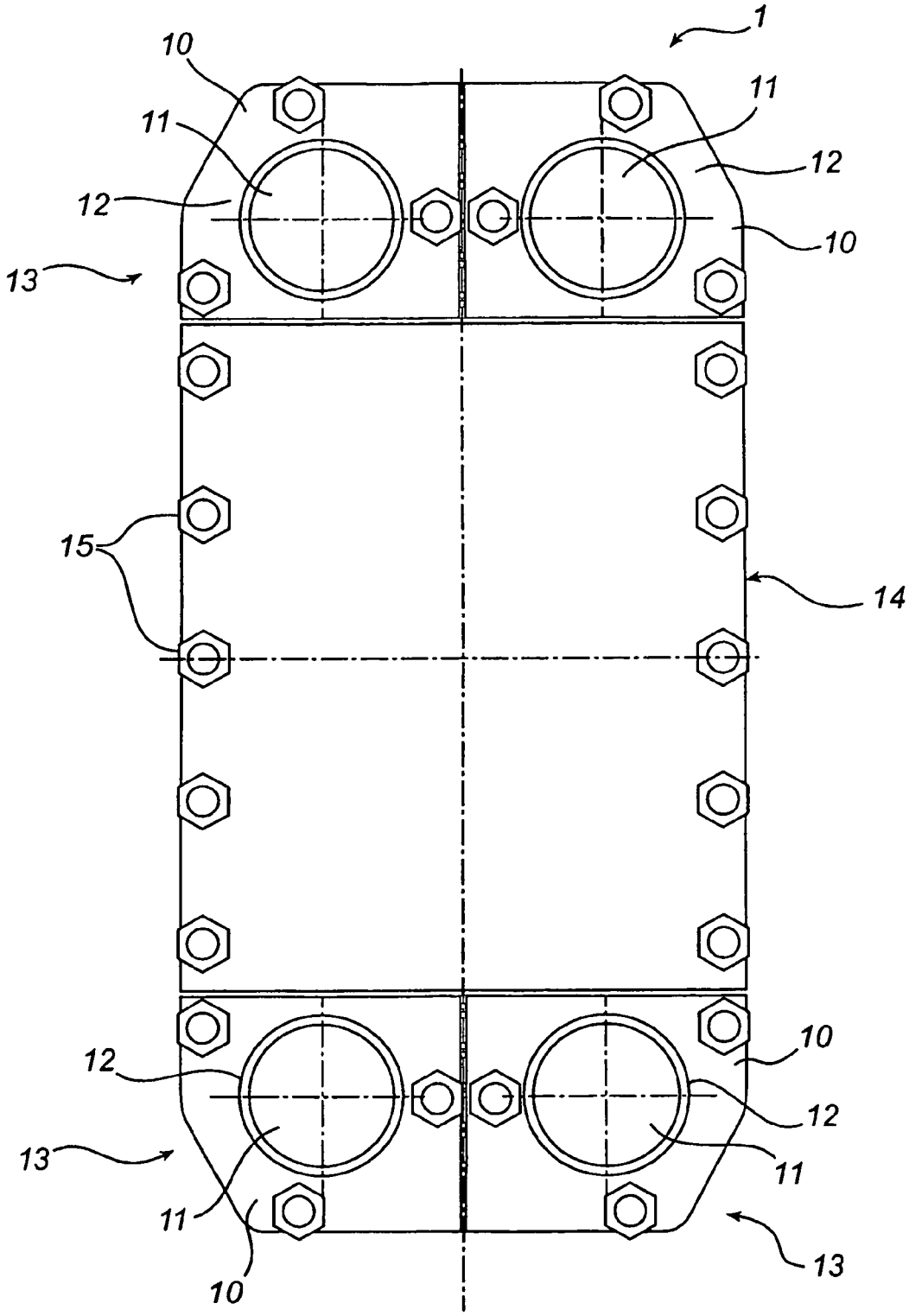
FIG. 1 shows an end plate according to a first embodiment, which is intended to be used in a plate heat exchanger according to the present invention.

The end plate shown in FIG. 1 is a frame plate 1 intended to form, together with an additional plate, a "pressure plate" (not shown), the main components of a plate heat exchanger frame. The frame plate 1 is divided into relatively displaceable segments 10 and each corner thereof is provided with a through port opening 11, connecting pipes 12 being arranged at said openings. The through port openings 11 and the connecting pipes 12 allow inflow and outflow of a number of (usually two) heat exchanging fluids in the plate heat exchanger. As shown in FIG. 1, each segment 10 comprises no more than one through port opening 11 and a connecting pipe 12 associated therewith. Each separate unit consisting of segments 10, through port openings 11 and connecting pipes 12 is referred to as a connecting module 13. FIG. 1 shows the four connecting modules 13 of the frame plate 1.

An elongate central segment 14 is provided at the centre of the frame plate, with two of the connecting modules 13 located on either short side.

The two end plates included in the frame may both be designed as described above, i.e. both the pressure plate and the frame plate of the frame may be segmented. In this case, the corresponding connecting modules on the respective pressure and frame plates are interconnected. FIG. 1 illustrates how clamping is achieved by means of clamp bolts 15. At least two bolts 15 are used to hold the respective connecting modules 13 together on respectively the pressure plate and the frame plate. It is preferred, however, to have three or more bolts 15 for each pair of connecting modules 13. In addition, a number of bolts 15 are arranged along the longitudinal edges of the centre segment 14 to clamp together the centre segments of the frame plate and the pressure plate.

If only one of the two end plates included in the frame is segmented, the segment of one plate is clamped together with the other unsegmented plate. Bolts may be used here as well.

Figure 2:
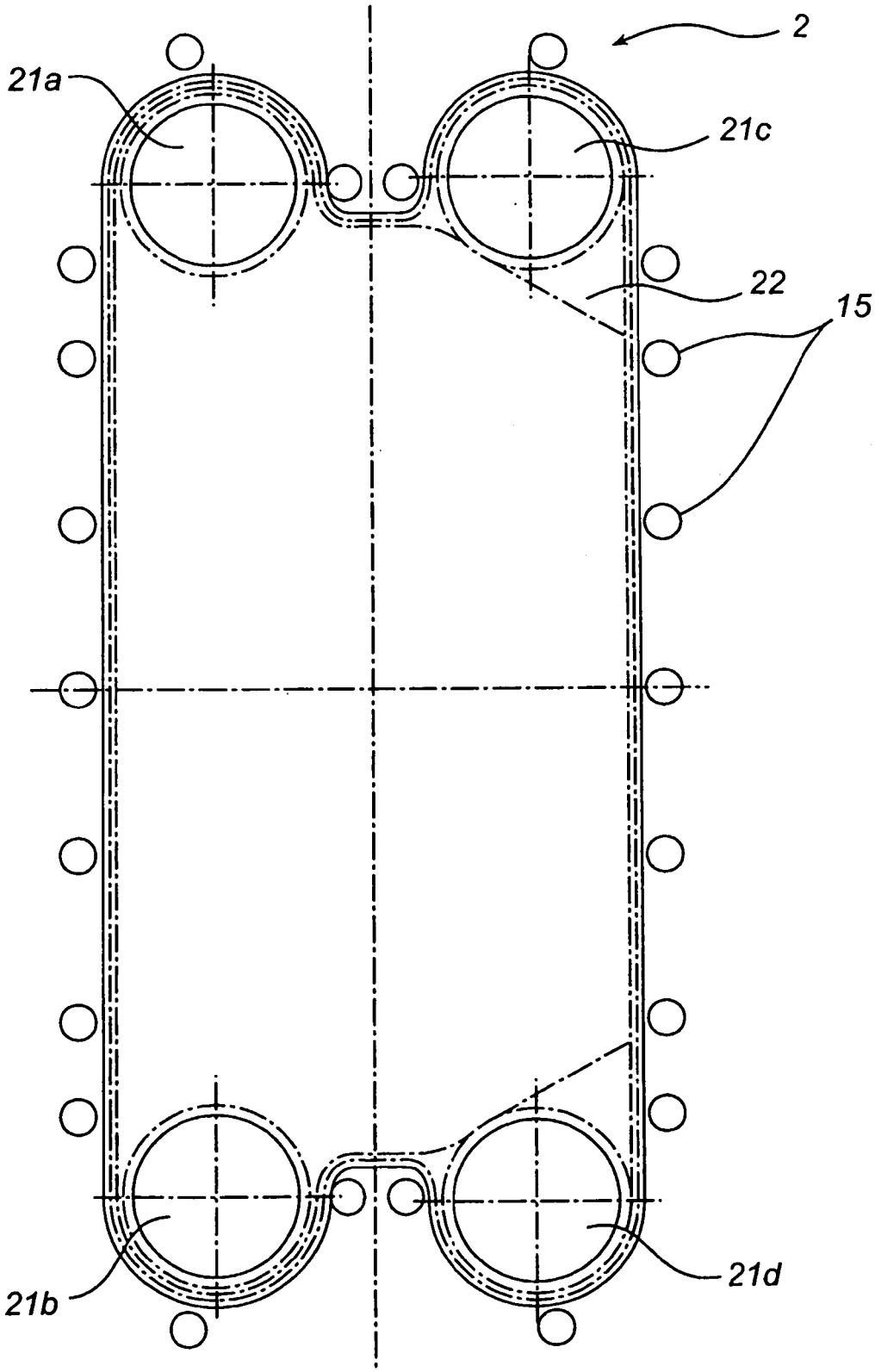
FIG. 2 shows a heat transfer plate associated with the end plate of FIG. 1.

FIG. 2 shows a heat transfer plate 2 that is intended to be used together with the frame plate 1 shown in FIG. 1. The four corners of the heat transfer plate 2 are provided with through ports 21*a*–*d*. The four ports 21*a*–*d*, a first and a second inlet port 21*a*, 21*b* and a first and a second outlet port 21*c*, 21*d*, form together with the ports of the other heat transfer plates a first and a second inlet channel and a first and a second outlet channel through the plate pack formed by the heat transfer plates 2. The location of the ports 21*a*–*d*on the heat transfer plates 2 corresponds to the location of the through port openings 11 on the frame plate shown in FIG. 1. The channels formed through the pack of heat transfer plates 2 communicate with the connecting pipes 12 of the frame plate 1.

A fluid-tight sealing means 22, for instance a gasket or weld, is provided on the heat transfer plate 2 and extends round a first inlet and outlet port 21*a* and 21*b*, respectively. A similar sealing means is provided on every second heat transfer plate of the plate pack. On the intermediate heat transfer plates a sealing means is provided which extends round a second inlet and outlet port 21*c* and 21*d*, respectively. Said sealing means contribute to the formation of two separate channels extending through the plate heat exchanger, one for the first heat exchanging fluid and one for the second heat exchanging fluid.

The clamp bolts 15 shown in FIG. 1, which clamp together the two end plates included in the frame, are shown also in FIG. 2. In FIG. 2, the bolts are arranged close to the outer edges of the heat transfer plate 2.

Figure 3:
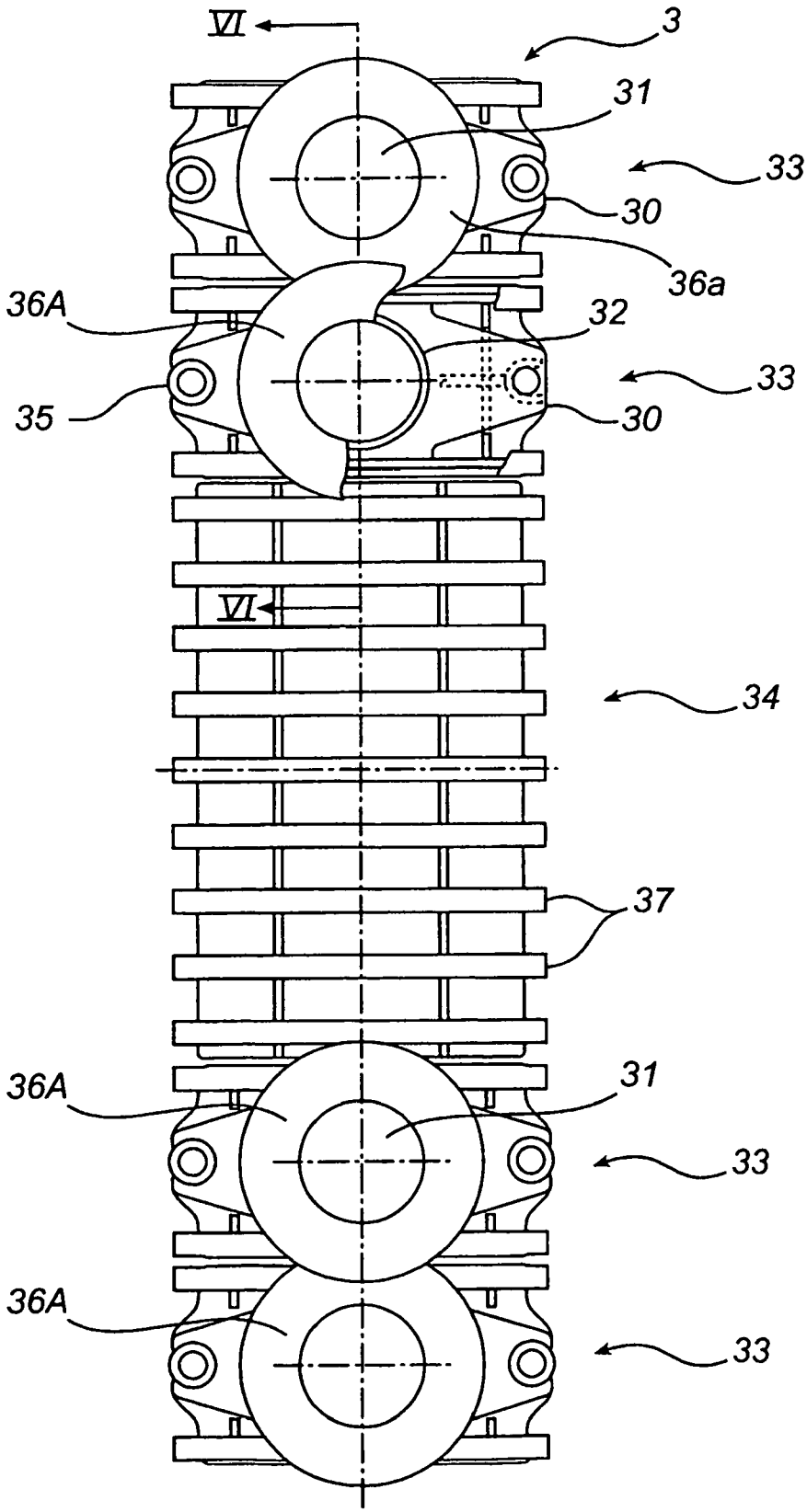
FIG. 3 shows an end plate according to a second embodiment, which is intended to be used in a plate heat exchanger according to the present invention.

FIG. 3 shows a frame plate 3 according to a second embodiment, which together with the pressure plate is intended to form the main components of a plate heat exchanger frame. As in the first embodiment, the frame plate 3 comprises relatively displaceable segments 30. However, the positioning of the through port openings 31 and the connecting pipes 32 associated therewith differs from the first embodiment. In the second embodiment, the through port openings 31 are positioned along the geometric centre line of the frame plate 3. Thus, four connecting modules 33, which consist of a segment 30, a through hole 31 and a connecting pipe 32, are arranged in pairs beneath each other with a central segment 34 arranged in between. The four connecting modules 33 are essentially identical, except for the length of the connecting pipes 32. FIG. 3 also shows a first flange 36A arranged adjacent to each connecting pipe 32 for connecting the pipes (not shown) through which the fluids are fed to the plate heat exchanger.

As in the first embodiment, set bolts 35 hold the respective connecting modules 33 of the frame and the pressure plates together. The two plates included in the frame can be joined, as shown in FIG. 3, by means of bolted joints 37 arranged round the plate heat exchanger.

Figure 4:
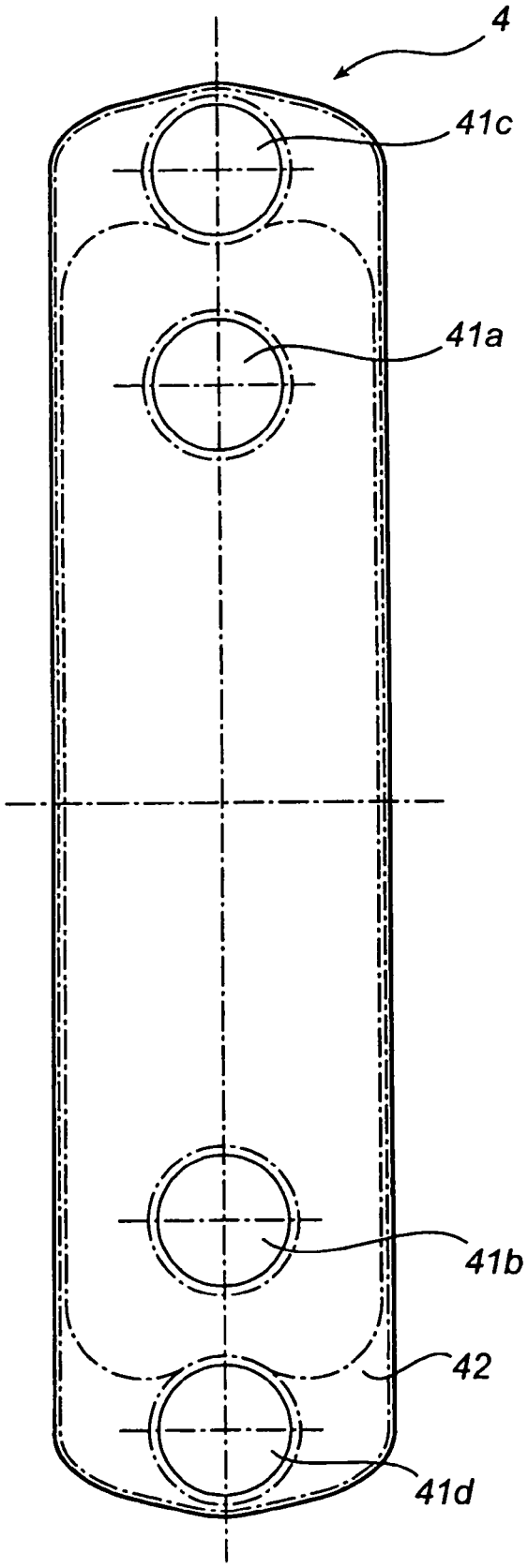
FIG. 4 shows a heat transfer plate associated with the end plate of FIG. 3.

FIG. 4 shows an alternative embodiment of a heat transfer plate 4 which is intended to be used together with the frame plate 3 shown in FIG. 3 and which, therefore, has an equivalent appearance. The through ports of the heat transfer plate 4, i.e. first inlet and outlet ports 41*a*, 41*b* and second inlet and outlet ports 41*c*, 41*d*, are arranged along the longitudinal axis of the heat transfer plate 4 so that their positions correspond to the positions of the through port openings 31 on the frame plate 3 shown in FIG. 3.

A fluid-tight sealing means 42, for instance a gasket or weld, extends round a first inlet and outlet port 41*a* and 41*b*, respectively. As described above, similar sealing means are provided on every second heat transfer plate of the plate pack. On the intermediate heat transfer plates a sealing means is provided which extends round a second inlet and outlet port 41*c* and 41*d*, respectively. Said sealing means thus contribute to the formation of two separate channels through the plate heat exchanger, one for the first heat exchanging fluid and one for the second heat exchanging fluid.

Figure 5:
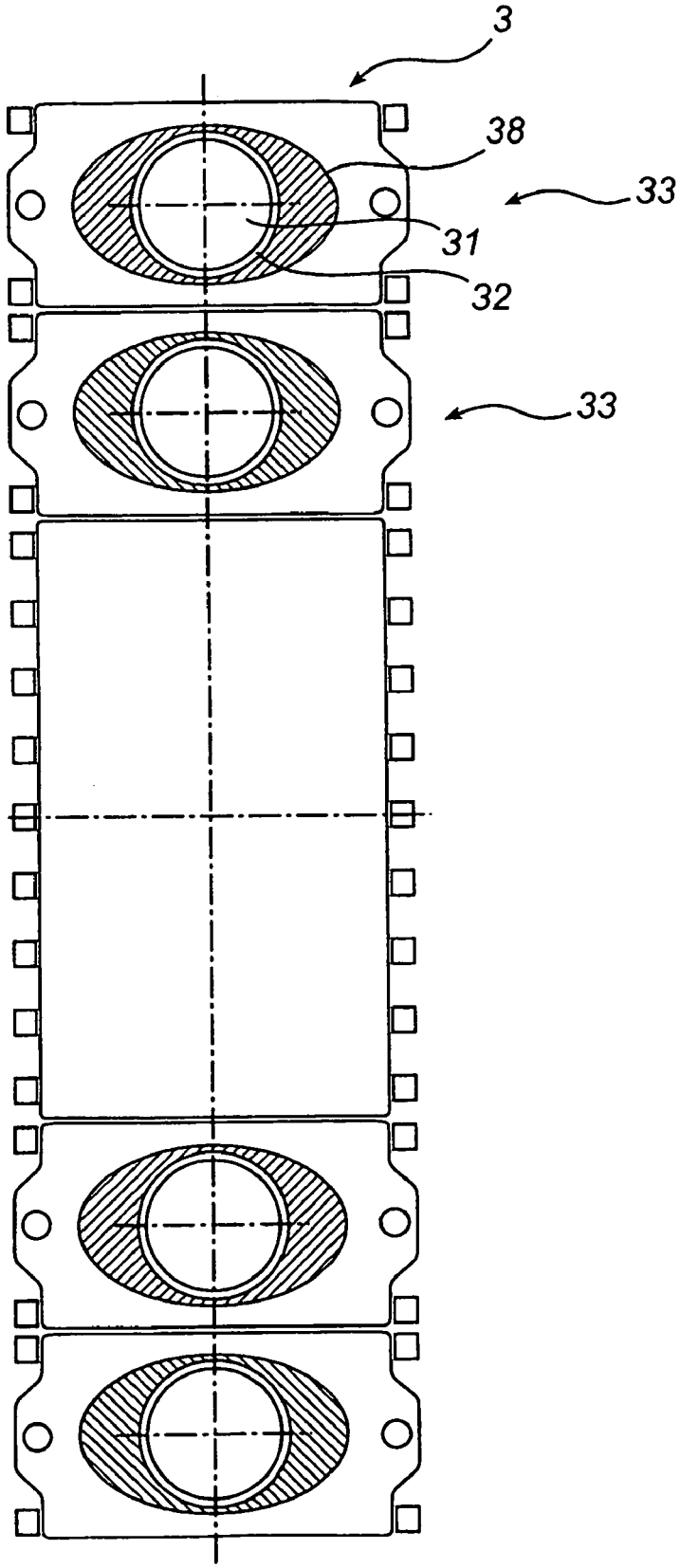
FIG. 5 shows the end plate illustrated in FIG. 3 from the opposite side.

For engagement between the two end plates of the frame and the intermediate heat transfer plates, a fixing pattern may be provided on the frame end plates. As shown in FIG. 5, the frame plate 3 illustrated in FIG. 3 has a fixing pattern 38 arranged round the through port openings 31 and the connecting pipes 32. Thus, the side of the frame plate 3 shown in FIG. 5 is the one that is oriented towards the pack of heat transfer plates and abuts against the outermost heat transfer plate of the plate pack, the terminal plate. This allows the fixing pattern 38, which consists of pressed ridges and troughs, to engage the terminal plate, either the terminal plate itself or, preferably, a corresponding fixing pattern provided thereon. In this manner, each connecting module 33 is fixedly attached to the through ports of the terminal plates.

The purpose of said engagement is to obtain a flexibility between the frame and the pack of heat transfer plates as the plate pack is subjected to a length change that is not matched by a corresponding change in the frame plate and the pressure plate, respectively. The flexibility is also facilitated by the segmented end plates of the frame.

Naturally, the provision of fixing patterns on the two end plates of the frame and the respective terminal plates may be applied also in connection with the first embodiment as shown in FIGS. 1 and 2.

Figure 6:
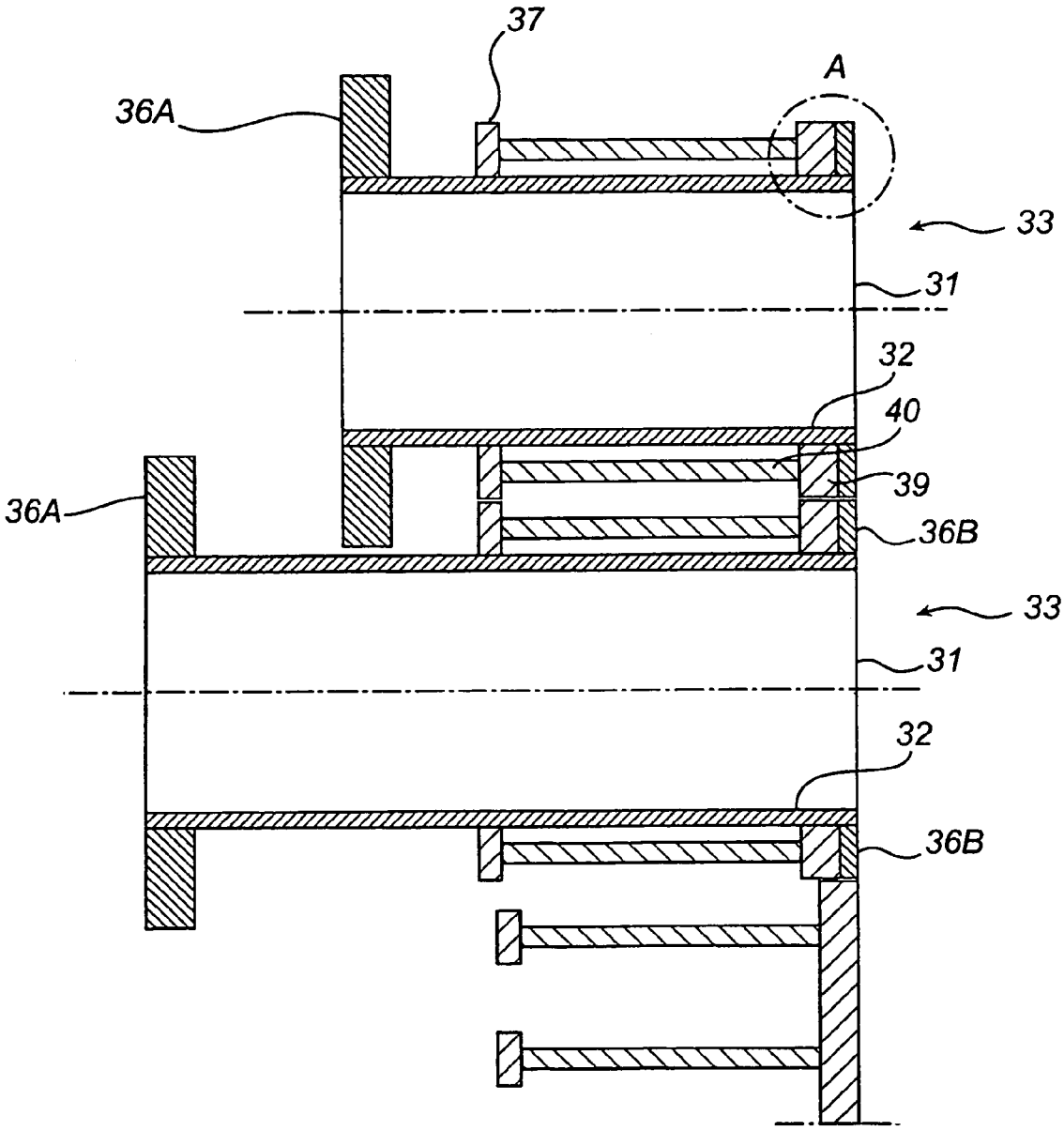
FIG. 6 is a sectional view along the line VI—VI in FIG. 3.

FIG. 6 is a sectional view of the frame plate along the line VI—VI in FIG. 3. Two connecting modules 33 are shown having through port openings 31 as well as connecting pipes 32. The connecting pipes 32 are of different lengths and are provided at their free end with a first flange 36A. Similarly, the ends of the connecting pipes 32 are provided round the port openings 31 of the frame plate 3 with a second flange 36B. The first flanges 36A, connecting pipes 32 and the second flanges 36B are joined so as to form a unit, preferably by welding, and have similar corrosion properties.

As stated above, a bolted joint is arranged round the plate heat exchanger to hold together the two end plates of the frame. The forces generated inside the plate heat exchanger are transmitted to the bolted joint 37 via a first and a second element 39, 40 arranged between the second flange 36B and the bolted joint 37.

Figure 7:
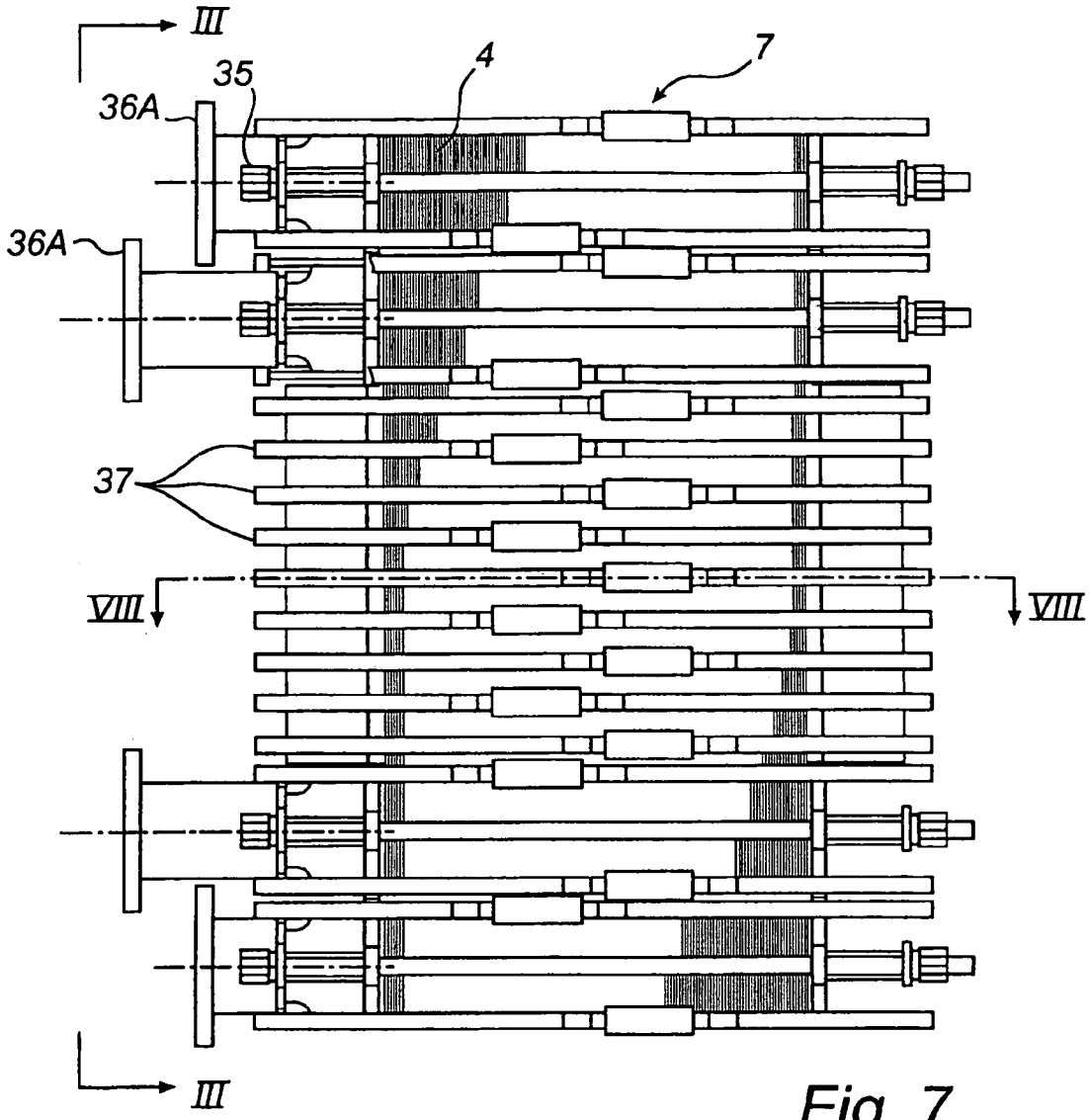
FIG. 7 is a side view of a plate heat exchanger having an end plate according to FIG. 3 and heat transfer plates according to FIG. 4.
Figure 8:
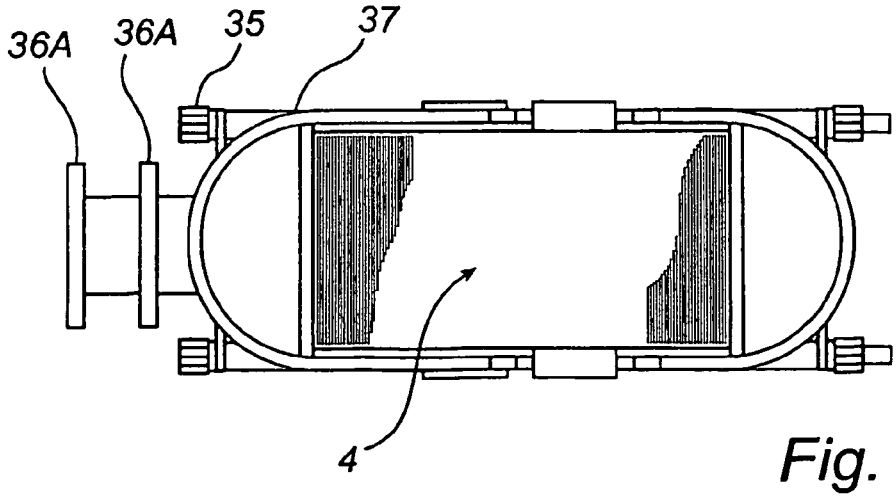
FIG. 8 is a sectional view along the line VIII—VIII in FIG. 7.

FIG. 7 is a side view of a plate heat exchanger 7 with the frame plate 3 as shown in FIG. 3 and heat transfer plates 4 as shown in FIG. 4. FIG. 7 shows more clearly the arrangement of the bolted joint 37 round the plate heat exchanger 7. In addition, FIG. 8 illustrates the semicircular extension of the bolted joint 37 round each of the end plates.

Figure 9:
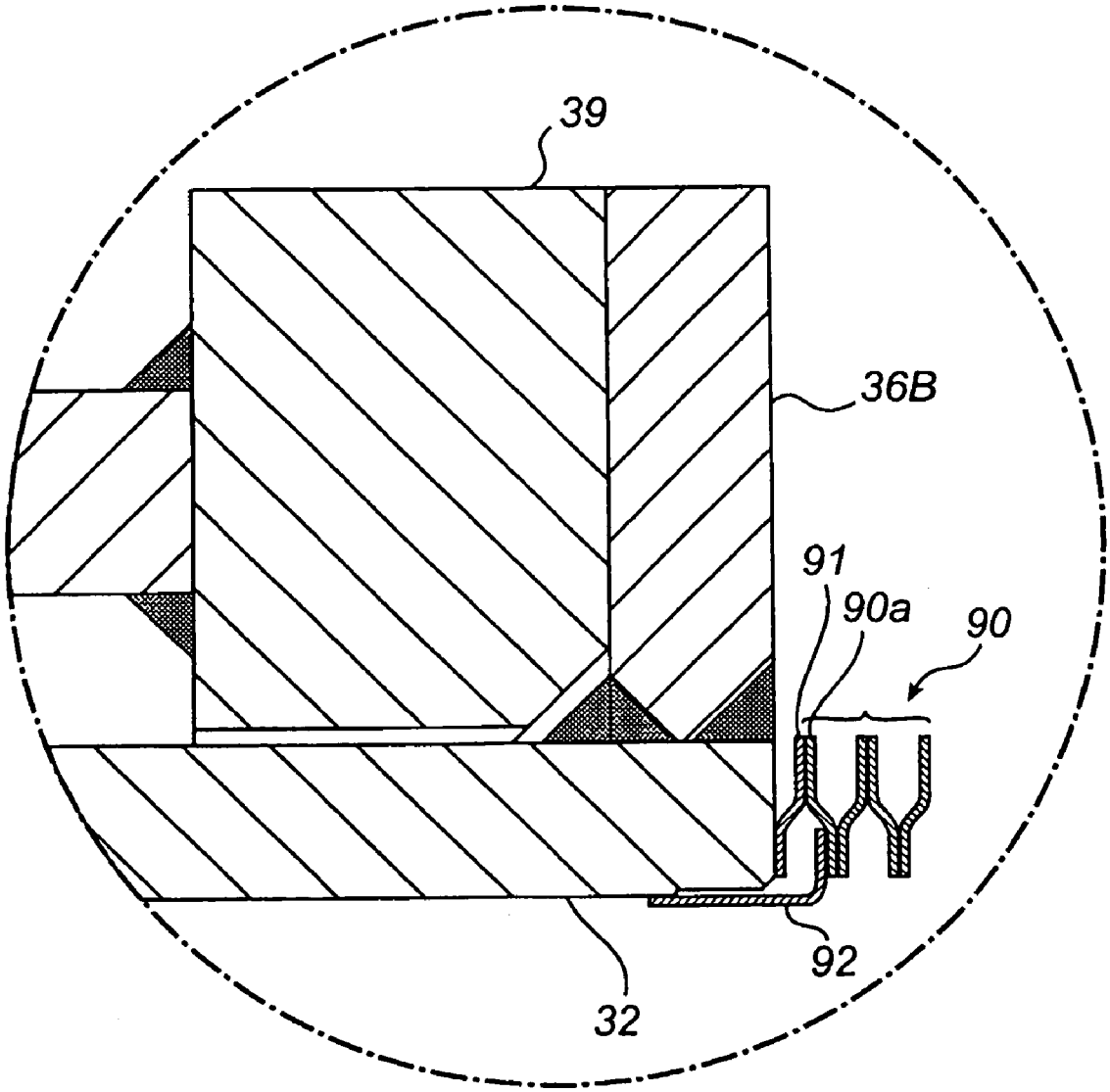
FIG. 9 is an enlarged view of the part A shown in FIG. 6.

To absorb the wear between the terminal plates and the end plates of the frame, a sliding element 91 is arranged between the pack of heat transfer plates 90 and the end plate, as shown in FIG. 9. The sliding element 91 engages the outermost heat transfer plate, the terminal end plate 90*a*, by means of a fixing pattern provided on the end plate 90*a* and/or on the sliding element 91, and is slidingly displaced towards the end plate 3. This means that the end plate 3, which is less sensitive to wear, will absorb the wear.

FIG. 9 also shows how the plate pack and the connecting pipe 32 of the end plate are held together by means of a flange 92.

As regards materials, the heat transfer plates preferably consist of pressed sheet metal whereas the end plates may consist, for example, of carbon steel.

It will be appreciated that various modifications of the preferred embodiments described above are possible within the scope of the invention, as defined by the appended claims. For example, the segments of the frame plates shown in FIGS. 1 and 3 may comprise more than one port opening. In the case where the port openings are positioned close to each other, it is possible to provide a segment with more than one, suitably two, port openings.

Furthermore, in some cases the end plates and the respective outermost heat transfer plates, the terminal plates, may be separated by an intermediate plate. Thus, direct engagement between the end plates and the terminal plates is not possible, as described above in connection with the fixing pattern of FIG. 5; instead the plates engage via the intermediate plate.

Moreover, engagement between the end plates and the terminal plate/intermediate plate or between the terminal plate and the sliding element by means of the fixing pattern as described above can be wholly or partly replaced by increased friction between the plates. The increased friction may be achieved, for instance, by providing the plates with friction-enhancing surfaces.

The invention claimed is:

1. A plate heat exchanger comprising two end plates, at least one of the end plates being provided with a number of port openings to allow inflow and outflow of a number of heat exchanging fluids, and a number of heat transfer plates located and clamped between the end plates, wherein at least one of the end plates comprises two separate segments, each of which segments is clamped to the other end plate by clamping means, and wherein the segments are relatively displaceable in the plane of the end plate to which they belong.

2. A plate heat exchanger according to claim 1, wherein each segment comprises a port opening.

3. A plate heat exchanger according to claim 2, wherein said port openings are positioned on the end plate along the same geometric center line.

4. A plate heat exchanger according to claim 1, wherein a surface with increased friction is arranged on at least one of the segments of the end plate or on an adjoining plate or on both the end plate and the adjoining plate.

5. A plate heat exchanger according to claim 4, wherein the increased friction is achieved by means of a fixing pattern arranged around said port opening in one of the segments of the end plate.

6. A plate heat exchanger according to claim 5, wherein the plate adjoining the end plate is provided with a fixing pattern corresponding to the fixing pattern on the end plate to obtain engagement between them.

7. A plate heat exchanger according to claim 6, wherein a sliding element is arranged between the heat transfer plates and the adjoining end plate.

8. A plate heat exchanger according to claim 7, wherein the sliding element is adapted to engage a neighboring heat transfer plate and to be slideably displaced towards the adjoining end plate.

9. A plate heat exchanger according to claim 8, wherein said engagement of the sliding element is obtained by means of a fixing pattern provided on either or both of the sliding element and said heat transfer plate.

10. A plate heat exchanger according to claim 1, wherein the clamping means comprises clamp bolts.

11. A plate heat exchanger comprising two end plates, at least one of the end plates being provided with a number of port openings to allow inflow and outflow of a number of heat exchanging fluids, and a number of heat transfer plates located between the end plates, wherein at least one of the end plates comprises two separate segments that are relatively displaceable in the plane of the end plate and further wherein a surface with increased friction is arranged on at least one of the segments of the end plate or on both the end plate and the adjoining plate.

* * * * *